US005957597A

United States Patent [19]

Kato

[11] Patent Number: 5,957,597

[45] Date of Patent: Sep. 28, 1999

[54] TAPE PRINTER AND PARTIAL CUT UNIT USED IN TAPE PRINTER

[75] Inventor: Shigeki Kato, Nagoya, Japan

[73] Assignee: Brother Kogyo Kabushiki Kaisha, Nagoya, Japan

[21] Appl. No.: 09/204,346

[22] Filed: Dec. 4, 1998

[30] Foreign Application Priority Data

Dec. 15, 1997 [JP] Japan ..... 9-345214

[51] Int. Cl.[6] ..... B41J 11/70

[52] U.S. Cl. ..... 400/621; 83/51; 83/861

[58] Field of Search ..... 400/621, 621.2; 83/51, 861, 881; 156/268, 270, 510; 101/224, 226, 227

[56] References Cited

U.S. PATENT DOCUMENTS

| | | | |
|---|---|---|---|
| 3,133,495 | 5/1964 | De Man | 400/621 |
| 3,237,494 | 3/1966 | Norvelle | 400/621 |
| 3,414,102 | 12/1968 | Norvelle | 400/421 |
| 5,066,152 | 11/1991 | Kuzuya et al. | 400/621 |
| 5,271,789 | 12/1993 | Takagi et al. | 156/386 |
| 5,458,423 | 10/1995 | Sims et al. | 400/621 |
| 5,556,213 | 9/1996 | Kudo et al. | 400/621 |
| 5,606,087 | 2/1997 | Beadman | 83/881 |

FOREIGN PATENT DOCUMENTS

| | | | |
|---|---|---|---|
| 0 319 209 A2 | 6/1989 | European Pat. Off. . | |
| 0 578 372 A2 | 1/1994 | European Pat. Off. . | |
| 0 611 722 A2 | 8/1994 | European Pat. Off. . | |
| 0 711 670 A2 | 5/1996 | European Pat. Off. . | |
| 0 719 620 A2 | 7/1996 | European Pat. Off. . | |
| 2-286367 | 11/1990 | Japan | 400/621 |
| 5-92629 | 4/1993 | Japan | 400/621 |
| A-6-286241 | 10/1994 | Japan . | |
| A-09-314938 | 12/1997 | Japan . | |

*Primary Examiner*—Christopher A. Bennett
*Attorney, Agent, or Firm*—Oliff & Berridge, PLC

[57] ABSTRACT

A partial cutting unit 32 is for cutting only a print tape 28 of a laminated tape 24, that is, without cutting a release tape 14 of the laminated tape 24. A blade support base 35 is mounted on a pivotal pin 34, pivotable with respect to a tape support base 33. A pair of step portions 33*a*, 33*b* is formed in the tape support base 33, one at the tip side of the tape support base 33 and the other near the pivotal pin 34. This pair of steps 33*a*, 33*b* is formed with a height H2, which is slightly smaller than the thickness of the release tape 24. A leg portion 35*a* for abutting against the step portion 33*a* is formed in the tip side of the blade support base 35. When the blade support base 35 is pivoted around the pivotal pin 34 to close against the tape support base 33, the leg portion 35*a* at the front tip of the blade support base 35 abuts against the step portion 33*a* at the tip side of the tape support base 33. In this condition, the cutting blade 36 is spot welded to the blade support base 35 while at both ends of a cutting edge 36*a* are in abutment with the pair of steps 33*a*, 33*b*.

20 Claims, 5 Drawing Sheets

TAPE PRINTER AND PARTIAL CUT UNIT USED IN TAPE PRINTER

BACKGROUND OF THE INVENTION

1. Field of Application

The present invention relates to a half cut unit for cutting only a print tape portion or a release tape portion of a laminated tape, which is formed by adhering the release tape to the back surface of the print tape after the print tape has had characters, figures, and the like printed on it by a tape printer.

2. Description of the Related Art

There has been known a type of laminated tape including a print tape and a peel-away release tape. To form such a laminated tape, the release tape is attached to a printed-on print tape by an adhesive precoated on the back surface of the printed-on print tape. When the print tape is to be attached to a predetermined object, such as a tape cassette or a file, the release tape is peeled off and the print tape is adhered to a surface of the object.

To peel the release tape off the print tape, the user inserts his or her fingernail between the intimately contacting print tape and release tape. Some people find this operation quite difficult, and can not easily peel the release tape off the print tape.

U.S. Pat. No. 5,556,213 discloses a half cut unit for cutting only a separate paper (release tape) of a laminated tape including a printing tape and the separate paper. Because only the printing tape is cut, a user can more easily separate the separate paper from the printing tape. The half cut unit includes a cutter for cutting the printing tape. The cutter includes a base plate formed with a pair of legs, and a cutting blade disposed on the base plate with its cutting edge extending between the guide legs. The base plate and the cutting blade are arranged so that the distance from the cutting edge to the ends of the guide legs is smaller than the thickness of the separate paper. A tape-receiving stand is provided for supporting the laminated tape from the separate paper side.

To cut the laminated tape, the cutter is moved toward the tape-receiving stand with the cutting edge maintained in parallel with the surface of the tape-receiving stand. The guide legs abut against the surface of the tape-receiving stand so that the printing tape is cut full through and the separate paper is only cut partially through.

SUMMARY OF THE INVENTION

However, in order to insure that the device disclosed in U.S. Pat. No. 5,556,213 fully cuts the printing tape and only partially cuts the separate paper as desired, the cutting blade must be fixed onto the base board so that the distance from the cutting edge to the ends of the guide legs is smaller than the thickness of the separate paper. Because the separate paper is extremely thin, fixing the cutting blade onto the baseboard to accurately meet this condition requires extreme precision and is therefore extremely difficult a predetermined.

Further, the cutting edge must be oriented in parallel with the support base when fixed onto the baseboard. Otherwise, the cutting edge might undesirably only cut through a portion of the printing tape or completely through the separate paper. This requirement for parallel orientation makes accurately fixing the cutting blade onto the baseboard even more difficult.

The device disclosed in U.S. Pat. No. 5,556,213 is a press cut type cutting unit, wherein the entire length of the cutting edge approaches the support base in a parallel condition with the support base and so cuts across the entire width of the print tape at the same time. A good deal of power is required to cut the printing tape in this manner so that either a large drive source is required for driving movement the cutting blade or a power magnifying transmission mechanism is necessary. Regardless, the half-cut unit must be made large enough to accommodate these components.

It is an objective of the present invention to overcome the above-described conventional problems and to provide a partial (half) cut unit wherein only one of the print tape or the release tape of the laminated tape can be cut with only a small force and moreover, wherein the cut blade can be easily attached.

To achieve these objectives, a partial cut unit according to the present invention, for cutting one of a release tape and a print tape of a laminated tape configured by the release tape laminated on the print tape, includes a cutting blade, a support base, and a support mechanism. The cutting blade has a cutting edge for cutting the one of the release tape and the print tape from a first surface of the laminated tape. The cutting edge extends to a length.

The support base is formed with a pair of step portions and a base surface between the step portions. The base surface supports a second surface of the laminated tape when the one of the release tape and the print tape is cut. Each of the step portions is formed with a height from the base surface equal to or less than a thickness of the laminated tape desired to be left uncut. Further, the step portions are separated from each other by a distance less than the length of the cutting edge.

The support mechanism supports the cutting blade movable toward and away from the support base. Movement of the cutting blade toward the support base brings the cutting edge into abutment with both of the step portions.

Because the support mechanism supports the cutting blade so that the cutting edge abuts both of the step portions when the support mechanism moves the cutting blade toward the support base, the cutting edge of the cutting blade can easily be maintained separated from support base by a fixed distance and a parallel condition with the support base without requiring, for example, a clasp. Therefore, the support base and the cutting blade can be simply fixed at this predetermined position with good precision. Additionally, the support mechanism can be provided with a leg portion that abuts against one of the step portions when the both edges of the cutting edge abut against the step portions.

According to another aspect of the present invention, the support mechanism can be configured for moving the cutting blade toward the support base in the manner of a pair of scissors. In this case, the support mechanism includes a blade support member for supporting the cutting blade and a pivotal shaft pivotably supporting the blade support member. The pivotal shaft is separated from the cutting blade in a direction following the cutting edge along the length of cutting edge. With this configuration, pivoting movement of the blade support member about the pivotal shaft moves the cutting blade into contact with the laminated tape progressively from portions of the cutting edge closer to the pivotal shaft to portions of the cutting edge farther from the pivotal shaft.

Striking effects are attained by this configuration. By pivoting the cutting blade and its support base around the support base, the laminated tape will be cut gradually from one end in the widthwise direction. Therefore, compared to press cutting type cutting operation, wherein the laminated tape is cut across its entire width all at one time, only an extremely slight cutting force is required. Accordingly, the drive means can be more compact and the drive source can be one with a small output. The cost for producing the partial cut unit can be reduced.

BRIEF DESCRIPTION OF THE DRAWINGS

FIG. 8(*b*) is a magnified cross-sectional view showing the cutting blade and the support base in the condition shown in FIG. 7.

DETAILED DESCRIPTION OF THE PREFERRED EMBODIMENT

Figure 1:
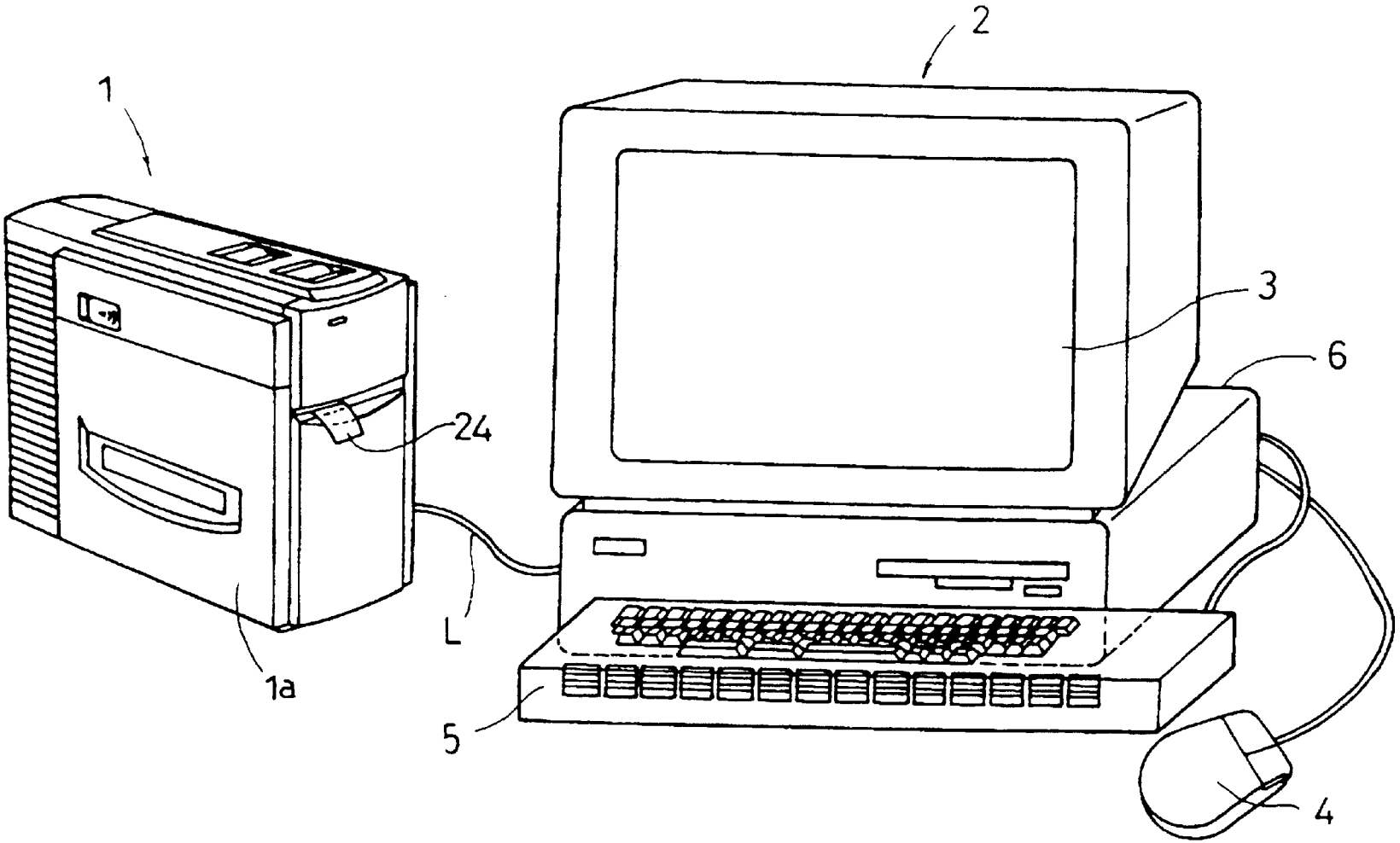
FIG. 1 is a perspective view of a personal computer connected to a tape printer according to an embodiment of the present invention.

Next, an explanation will be provided for an embodiment of the present invention. FIG. 1 is a perspective view showing a tape printer 1 for printing a laminated tape 24 and a personal computer 2 for preparing character data and the like used by the tape printer 1 when printing the laminated tape 24. The personal computer 2 includes a cathode ray tube (CRT) 5, a main body 6, a keyboard 3, and a mouse 4. The keyboard 3, the mouse, 4, and the CRT 5 are connected to the main body 6 by cable lines. Further, the tape printer 1 is also connected to the control device (computer) 6 via a connection line L.

The keyboard 3 is provided with a variety of operation keys, such as keys for inputting characters and symbols and cursor movement keys for moving a cursor vertically and horizontally across a display portion of the CRT 5. The mouse 4 serves as a coordinate input unit. The cathode ray tube 5 is capable of displaying a plurality of lines of characters.

Figure 2:
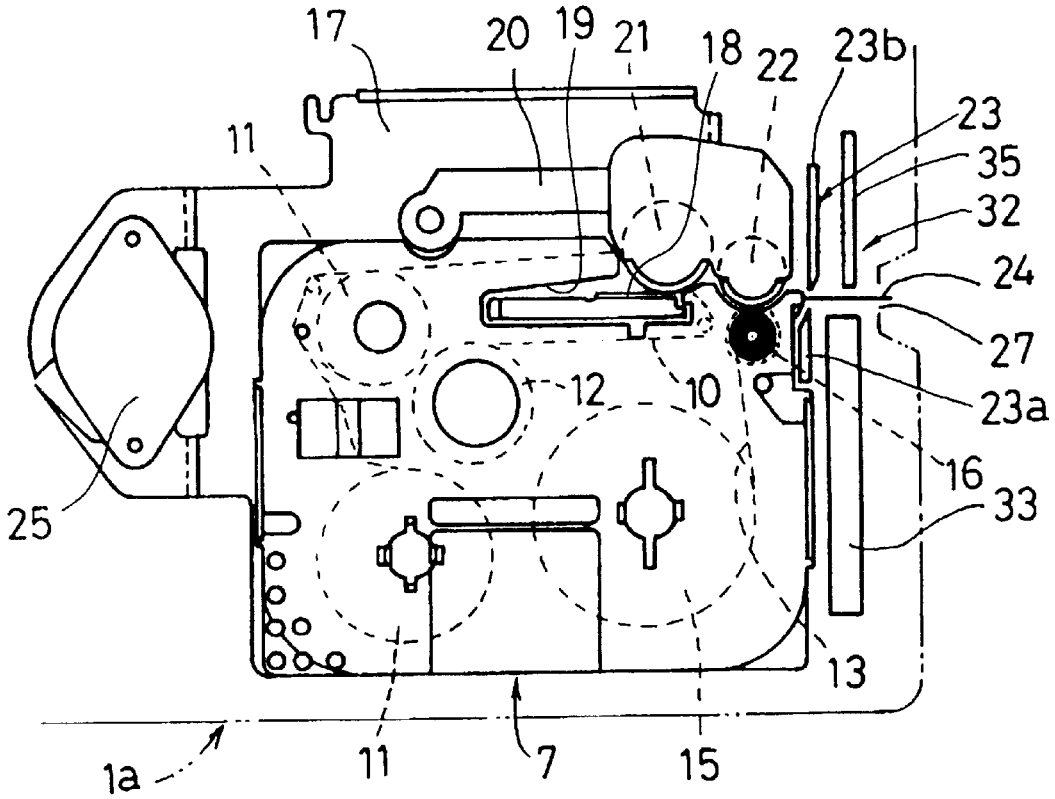
FIG. 2 is a plan view of a cassette-housing portion in the tape printer.

Next, while referring to FIG. 2, a simple explanation will be provided for the printing mechanism in the tape printer 1. The tape printer 1 has a case 1*a*. A cassette mounting frame 17 is disposed to the inside of the case 1*a*. The cassette mounting frame 17 is adapted to freely detachably receive a tape housing cassette 7. The cassette mounting frame 17 is provided with structure for freely rotatably receiving a tape spool 9 wound with a transparent surface layer tape 8 made from PET (polyethylene terephthalate) film; a ribbon supply spool 11 wound with an ink ribbon 10; a wind-up spool 12 for winding up spent ink ribbon 10; a base member supply spool 15 wound with a two-sided adhesive tape 13 having adhesive layers on both surfaces, and a release tape 14 attached to the two sided adhesive tape 13 via one of the adhesive layers; and a coupling roller 16 for coupling together the two sided adhesive tape 13 and the surface layer tape 8 in an overlapping condition. It should be noted that the two-sided adhesive tape 13 has the same width as the surface layer tape 8. Also, the two-sided adhesive tape 13 and the release tape 14 are wound around the base member supply spool 15 so that the release tape 14 faces outward.

A thermal head 18 is disposed on the cassette-mounting frame 17. The thermal head 18 is disposed in an indentation portion 19 of the tape-housing cassette 7. The thermal head 18 is positioned where the surface layer tape 8 and the ink ribbon 10 pass in an overlapped condition with each other. Although not shown in the drawings, thermal elements are aligned in a row on the thermal head 18

A roller holder 20 is pivotably disposed on the cassette-mounting frame 17. The roller holder 20 is provided near its center with a platen roller 21 and at its tip with a feed roller 22 so that when the roller holder 20 is pivoted into the posture shown in FIG. 2, the platen roller 21 is pressed toward the thermal head 18 and the feed roller 22 is pressed toward the coupling roller 16.

A scissors type cutter portion 23 for completely severing the laminated tape 24 is disposed adjacent to the feed roller 22 and the coupling roller 16. The cutter portion 23 includes a fixed blade 23*a* and a pivot blade 23*b* disposed pivotable with respect to the fixed blade 23*a*. The pivot blade 23*b* is operated to pivot toward the fixed blade 23*a*, thereby cutting cut the laminated tape 24 disposed therebetween, by a user manually pressing a lever not shown in the drawings. A partial cut unit 32 according to the present invention is disposed between the cutter portion 23 and a discharge portion 27 in the case la of the tape printer 1. The partial cut unit 32 will be described in further detail later.

A drive motor 25 is disposed on the cassette mounting frame 17 as a drive source for rotating the wind-up spool 12, the feed roller 22, and the coupling roller 16 in synchronization via a gear mechanism not shown in the drawings.

As mentioned above, the tape printer 1 prints the laminated tape 24 based on print data prepared by the personal computer 2. To print the laminated tape 24, the drive motor 25 is driven to rotate so that the wind-up spool 12, the feed roller 22, and the coupling roller 16 rotate in synchronization via the gear mechanism. At this time, the thermal elements of the thermal head 18 are selectively energized to form dot rows of ink 29 on the surface of the surface layer tape 8. In this way, images formed from ink dots are printed on the surface layer tape 8. Afterward, the two-sided adhesive tape 13 is laminated on and adhered to the print surface of the surface layer tape 8. The surface layer tape 8 and the two sided adhesive tape 13 adhered in this manner are transported, as the printed-on laminated tape 24, to the cutter portion 23.

Figure 3:
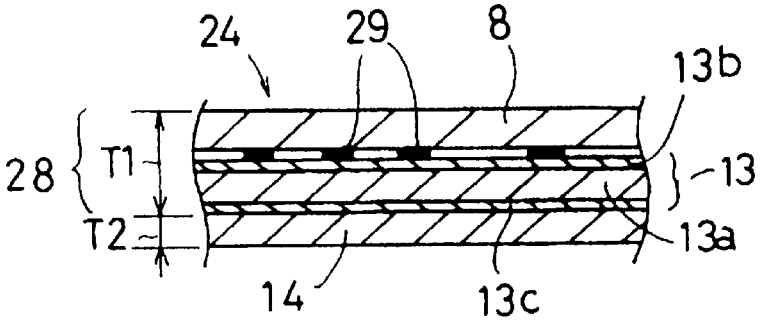
FIG. 3 is a magnified cross-sectional view of a laminated tape produced by the tape printer.

FIG. 3 is a magnified cross-sectional view showing the printed-on laminated tape 24. The laminated tape 24 is formed from the two sided tape adhesive 13 sandwiched between the transparent upper surface layer tape 8 on one side and the release tape 14 on the other. Dot rows of ink 29 in the mirror image of characters cling on the underside surface of the transparent upper surface layer tape 8, which is formed from PET as described above.

The two sided adhesive tape 13 is formed from a base member tape 13*a* formed with adhesive layers 13*b*, 13*c* on either surface. The transparent upper surface layer tape 8 is attached at its underside surface to one surface of the base member tape 13*a* by the adhesive layer 13*b*. The release tape 14 is attached to the other surface of the base member tape 13*a* by the adhesive layer 13*c* so that the release tape 14 covers the underside of the base member tape 13*a*. The transparent upper surface layer tape 8 and the two sided adhesive tape 13 together form a printed tape 28 having a thickness T1, which, as will be described later, the partial cut unit 32 is designed to cut completely through. The release tape 14 has a thickness T2, which, as will be described later, the partial cut unit 32 is designed to retain uncut. The entire laminated tape 24 has a thickness T3 equal to the sum of the thickness T1 and the thickness T2. It should be noted that printed tapes 28 can be provided in a variety of colors by changing coloring at the surface of the base member tape 13*a* in confrontation with the colorless transparent surface layer tape 8.

Next, the partial cut unit 32 will be described while referring to FIGS. 5 through 8(*b*). The partial cut unit 32 includes a tape support base 33 formed from metal into a thick plate shape and fixed to, for example, the cassette mounting frame 17; a blade support base 35 pivotably mounted on a pivotal pin 34 and formed with an elongated guide groove 45; a cutting blade 36 fixed by, for example, spot welding 37 to the blade support base 35; and a drive mechanism 38 for driving pivoting movement of the blade support base 35.

Figure 5:
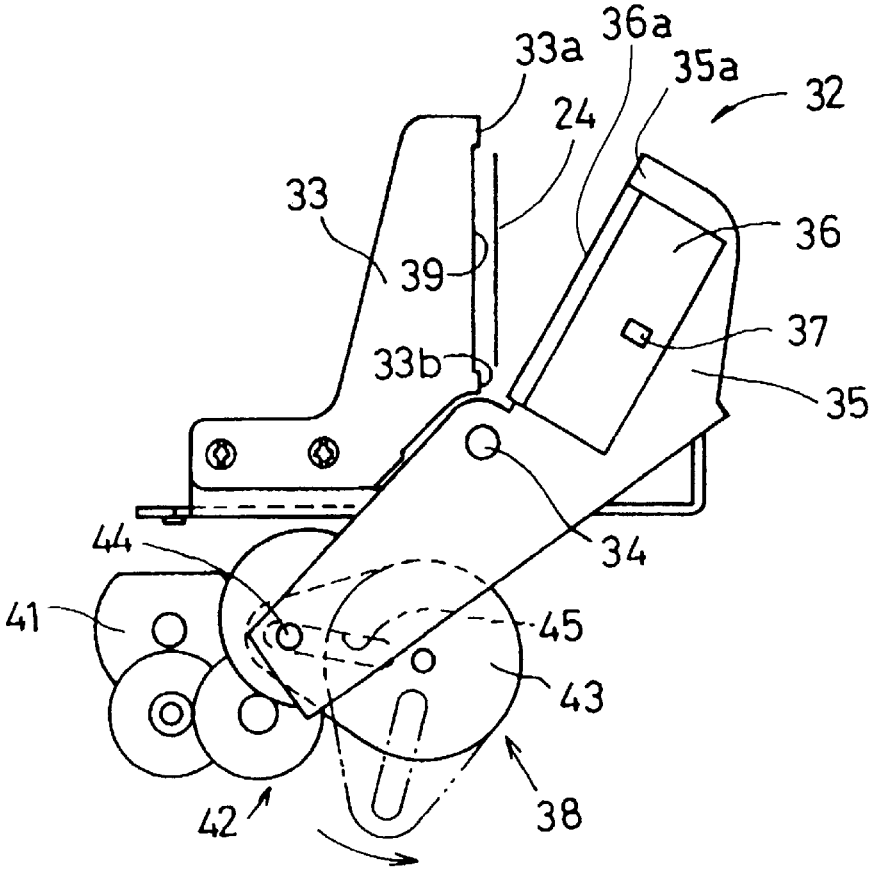
FIG. 5 is a front view of a partial cut unit according to the present invention, and provided in the tape printer.
Figure 6:
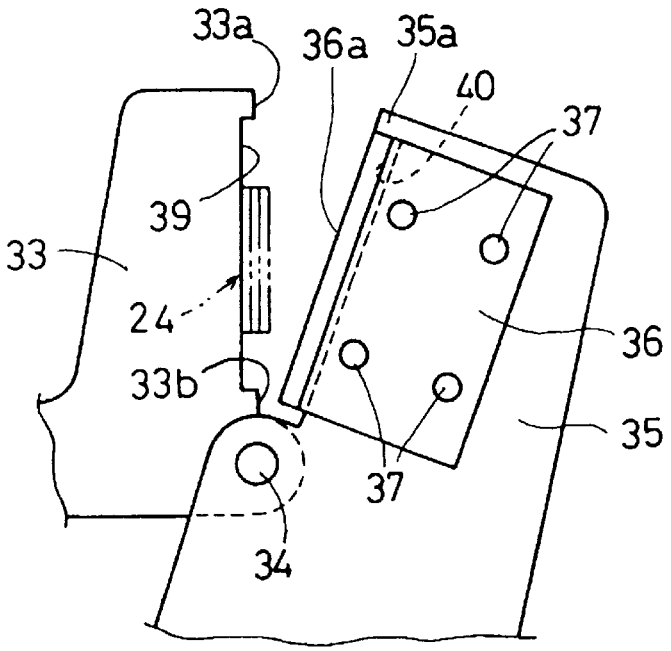
FIG. 6 is a magnified view of the partial cut unit, wherein a cutting blade is spread opened with respect to a support base.
Figure 7:
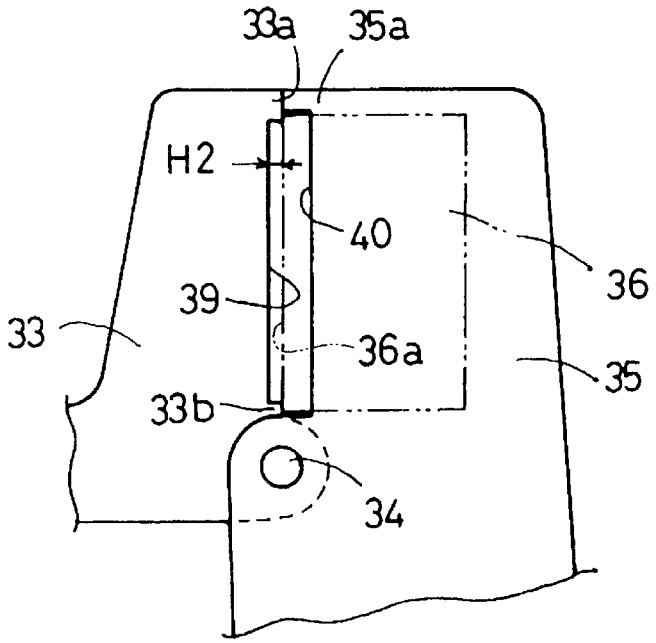
FIG. 7 is a magnified view showing the cutting blade closed shut against the support base.
Figure 8:
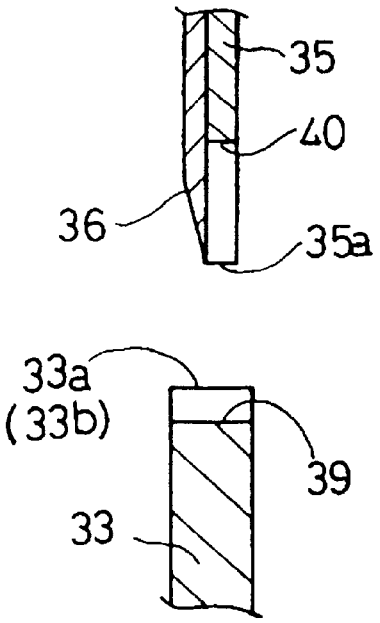
FIG. 8(*a*) is a magnified cross-sectional view showing the cutting blade and the support base in the condition shown in FIG. 6.
Figure 8:
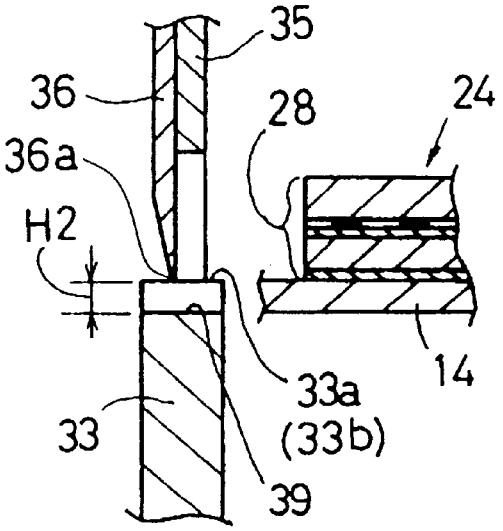

The drive mechanism 38 is for driving pivoting movement the blade support base 35, and consequentially the cutting blade 36, around the pivotal pin 34 so that the blade support base 35 pivots toward the tape support base 33 from the posture shown in FIGS. 6 and 8(*a*) to the posture shown in FIGS. 7 and 8(*b*). As shown in FIG. 5, the drive mechanism 38 includes a drive motor 41, such as a two directional DC motor; a gear train 42; and a crank 43 formed with a protruding pin 44 inserted into the guide groove 45. With this configuration, the blade support base 35 can be pivoted in the counterclockwise direction, as viewed in FIG. 5, toward the tape support base 33. That is, when the drive motor 41 is driven to rotate in a positive direction, rotational force from the drive motor 41 is transmitted by the gear train 42 to drive the crank 43 in the counterclockwise direction of FIG. 5. As a result, the pin 44 protruding from the crank 43 slidingly moves along the guide groove 45 so that the blade support base 35 rotates in the counterclockwise direction until the blade support base 35 abuts against the tape support base 33 in a manner to be described later. Although not shown in the drawings, a slide clutch is provided in the gear train 42 for preventing excessive load from being placed on the drive motor 41 after the blade support base 35 abuts against the tape support base 33.

The tape support base 33 is formed with a step portion 33*a* at its tip end and with a step portion 33*b* near the pivotal pin 34. A base surface 39 extends between the step portions 33*a*, 33*b* to a distance greater than the width of the release tape 14 (i.e., of the laminated tape 24). The step portions 33*a*, 33*b* extend from the base surface 39 by a distance H2, wherein the distance H2 is slightly smaller than the thickness T2 of the release tape 14. Said differently, the base surface 39 is receded by the same distance H2 from both of the step portions 33*a*, 33*b*. The step portions 33*a*, 33*b* and the base surface 39 are formed so that an imaginary line extending between the uppermost surfaces of the step portions 33*a*, 33*b* is parallel with the base surface 39.

As shown in FIG. 7, the blade support base 35 is formed with a leg portion 35*a* and a recessed surface 40. As will be described later, the leg portion 35*a* abuts against the step portion 33*a* when the blade support base 35 is pivoted toward the tape support base 33. The recessed surface 40 extends from the leg portion 35*a* substantially in the direction of the pivotal pin 34 and is receded away from the leg portion 35*a* by a distance greater than the thickness T3 of the entire laminated tape 24. It is noted that the distance from the surface 40 to the base surface 39, that is, when the blade support base 35 is closed against the tape support base 33, is set greater than the thickness T3. Further, the recessed surface 40 is formed with a broader width than the width dimension of the laminated tape 24.

The cutting blade 36 is positioned and fixed to the blade support base 35 in the following manner. First, the blade support base 35 is pivoted around the pivotal pin 34 toward the tape support base 33 until, as shown in FIG. 7, the leg portion 35*a* at the tip side of the blade support base 35 abuts against the step portion 33*a* at the tip side of the tape support base 33. While the blade support base 35 is closed against the tape support base 33 in this condition, the cutting blade 36 is set against the blade support base 35 and slid toward the tape support base 33 until both end portions of a linear cutting edge 36*a* of the cutting blade 36 abut against the uppermost surfaces of the pair of step portions 33*a*, 33*b*. Alternatively, while the blade support base 35 is closed against the tape support base 33, the cutting blade 36 could be placed on the tape support base 33 with the cutting edge 36*a* in abutment against the pair of step portions 33*a*, 33*b* and then set against the blade support base 35. While the cutting edge 36*a* abuts against the pair of step portions 33*a*, 33*b*, the cutting blade 36 is fixed to the blade support base 35 by spot welding 37, adhesive (not shown), or some other appropriate fixing material. Because the step portions 33*a*, 33*b* are configured so that portions thereof that abut with the cutting edge 36*a* are connected by an imaginary line in parallel with the base surface 39, by fixing the cutting blade 36 to the blade support base 35 while the cutting edge 36*a* abuts against the pair of step portions 33*a*, 33*b*, the cutting edge 36*a* can be oriented in parallel with the base surface 39.

By positioning and fixing the cutting blade 36 onto the blade support base 35 in this manner, the cutting edge 36*a* of the cutting blade 36 is positioned in a parallel orientation with respect to the base surface 39 of the tape support base 33. Further, the cutting edge 36*a* is separated from the base surface 39 by a gap precisely equal to the distance H2 between the step portions 33*a*, 33*b* and the base surface 39. Because the distance H2 is slightly smaller than the thickness T2 of the release tape 14, a desired thickness of the release tape 14 will remain uncut as will be described later. Moreover, the cutting blade 36 can be easily fixed to the blade support base 35 without use of, for example, a clasp. The precision of attachment is greatly improved compared to conventional configurations.

Although not shown in the drawings, a limit switch is provided at a position where it abuts against a suitable position of the blade support base 35 when the blade support base 35 is pivoted open to a desired maximum angle. Therefore, when the drive motor 41 is driven in the reverse direction to spread the cutting blade 36 away from the tape support base 33, the limit switch abuts against the blade support base 35 and outputs a predetermined signal, whereupon drive of the drive motor 41 is stopped when the blade support base 35 is pivoted open to a desired maximum angle.

Here, an operation for partially cutting the laminated tape 24 will be described. After a printing operation is completed, the laminated tape 24 is positioned on the base surface 39 as indicated by a two-dot chain line in FIG. 6. The drive motor 41 is driven in a forward direction to pivot the blade support base 35 toward the tape support base 33. Because the blade support base 35, and consequentially the cutting blade 36, is pivoted in this way around a pivot center (i.e., the pivotal pin 34) to close on the fixed tape support base 33, the space between the cutting edge 36*a* and the base surface 39 is narrower at positions nearer to the pivotal pin 34 than at positions farther from the pivot pin 34. Therefore, as the blade support base 35 moves toward the tape support base 33, the cutting edge 36*a* of the cutting blade 36 contacts and cuts into the laminated tape 24 starting from one end of the laminated tape 24 in the widthwise direction, that is, first at portions of the laminated tape 24 closer to the pivotal pin 34 and then progressively to portions of the laminated tape 24 farther from the pivotal pin 34.

Because the partial cut unit 32 cuts the laminated tape 24 in the manner of a pair of scissors in this way, only a small amount of drive force is needed to cut the laminated tape 24 compared to a pressing type cutter, which cuts a laminated tape across the entire width of the cutting edge at once. Accordingly, the drive mechanism 38 can be more compact and the drive motor 41 can be a motor with only a small output force, so the partial cut unit 32 can be made inexpensively.

Pivoting movement of the blade support base 35 toward the tape support base 33 continues until the leg portion 35*a* at the tip side of the blade support base 35 abuts against the step portion 33*a* at the tip side of the tape support base 33 as shown in FIG. 7. The operation for cutting the laminated tape 24 is completed when one end of the cutting edge 36*a* and the leg portion 35*a* abut against the step portion 33*a* of the tape support base 33. It should be noted that the partial cut unit 32 could be designed so that the other end of the cutting edge 36*a* simultaneously abuts the step portion 33*b* of the tape support base 33 upon completion of the cutting operation.

Figure 4:
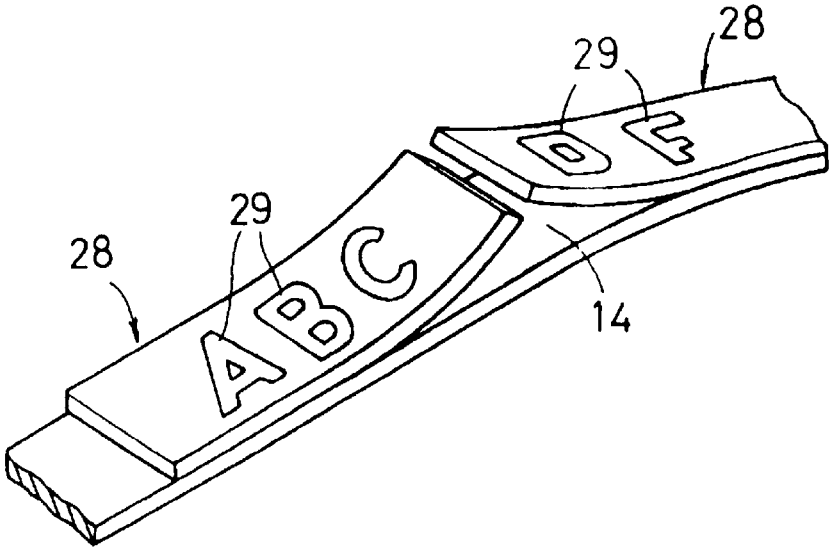
FIG. 4 is a perspective view of the laminated tape after being partially cut.

As shown in FIGS. 7 and 8(*b*), at completion of the cutting operation the cutting edge 36*a* is separated from the base surface 39 by the distance H2, because the distance H2 separates the tips of the step portions 33*a,* 33*b* from the base surface 39, because the cutting edge 36*a* abuts the step portions 33*a,* 33*b,* and because the leg portion 35*a* abuts the step portion 33*a*. The release tape 14 is only partially cut through because the distance H2 is slightly smaller than the thickness T2 of the release tape 14. Moreover, the printed tape 28 is cut completely through as shown in FIG. 4 because the recessed surface 40 is receded away from the leg portion 35*a* by a distance greater than the thickness T3 of the entire laminated tape 24.

The embodiment describes the release tape 14 positioned facing the base surface 39 of the tape support base 33 as shown in FIG. 8(*b*), so that cutting operations completely cut through the printed tape 28 and only partially cut through the release tape 14. However, the surface layer tape 8 could be positioned facing the base surface 39 of the tape support base 33 and then cutting performed so that only the release tape 14 of the laminated tape 24 is cut. In this case, the distance H2 from the step portions 33*a,* 33*b* to the base surface 39 is set to equal or less than thickness T1 of the printing tape 28 so that at least a portion of the printing tape 28 is retained uncut. In other words, the distance H2 from the step portions 33*a,* 33*b* to the base surface 39 is set to equal or less than a thickness of the laminated tape 24 desired to be left uncut.

What is claimed is:

1. A partial cut unit for cutting one of a release tape and a print tape of a laminated tape configured by the release tape laminated on the print tape, the partial cut unit comprising:

a cutting blade having a cutting edge for cutting the one of the release tape and the print tape from a first surface of the laminated tape, the cutting edge extending to a length;

a support base formed with a pair of step portions and a base surface between the step portions, the base surface supporting a second surface of the laminated tape when the one of the release tape and the print tape is cut, each of the step portions having a height from the base surface equal to or less than a thickness of the laminated tape desired to be left uncut, the step portions being separated by a distance less than the length of the cutting edge; and a support mechanism for supporting the cutting blade movable toward and away from the support base, movement of the cutting blade toward the support base bringing the cutting edge into abutment with both of the step portions.

2. A partial cut unit as claimed in claim 1, wherein the support mechanism includes:

a blade support member for supporting the cutting blade; and a pivotal shaft pivotably supporting the blade support member and separated from the cutting blade in a direction following the cutting edge along the length of cutting edge, whereby pivoting movement of the blade support member about the pivotal shaft moves the cutting blade into contact with the laminated tape progressively from portions of the cutting edge closer to the pivotal shaft to portions of the cutting edge farther from the pivotal shaft.

3. A partial cut unit as claimed in claim 2, wherein the step portions are configured so that portions thereof that abut with the cutting edge are connected by an imaginary line in parallel with the base surface.

4. A partial cut unit as claimed in claim 3, wherein the support mechanism is provided with a leg portion that abuts against one of the step portions when the both edges of the cutting edge abut against the step portions.

5. A partial cut unit as claimed in claim 4, wherein the step portions are separated by a distance greater than a width of a width of the laminated tape to be cut.

6. A partial cut unit as claimed in claim 5, wherein the cutting blade being attached to the support member so that the cutting edge of the cutting blade protrudes from the blade support member by a distance equal to or greater than a thickness of the laminated tape to be cut.

7. A partial cut unit as claimed in claim 1, wherein the step portions are configured so that portions thereof that abut with the cutting edge are connected by an imaginary line in parallel with the base surface.

8. A partial cut unit as claimed in claim 1, wherein the support mechanism is provided with a leg portion that abuts against one of the step portions when the both edges of the cutting edge abut against the step portions.

9. A partial cut unit as claimed in claim 1, wherein the step portions are separated by a distance greater than a width of the laminated tape to be cut.

10. A partial cut unit as claimed in claim 1, wherein the support mechanism includes a blade support member for supporting the cutting blade, the cutting blade being attached to the cutting blade so that the cutting edge of the cutting blade protrudes from the blade support member by a distance equal to or greater than a thickness of the laminated tape to be cut.

11. A partial cut unit as claimed in claim 1, wherein the support mechanism includes a blade support member for supporting the cutting blade, the cutting blade is attached to the blade support member with an orientation that aligns the cutting edge in parallel with the base surface when the cutting edge abuts the step portions.

12. A tape printer for producing printed laminated tapes configured from a release tape laminated on a print tape, the tape printer comprising:

a print head for printing on the print tape;

a discharge portion through which the laminated tape is discharged after the print head prints on the print tape; and a partial cut unit including:

a cutting blade having a cutting edge for cutting the one of the release tape and the print tape from a first surface of the laminated tape, the cutting edge extending to a length;

a support base formed with a pair of step portions and a base surface between the step portions, the base surface supporting a second surface of the laminated tape when the one of the release tape and the print tape is cut, each of the step portions having a height from the base surface equal to or less than a thickness of the laminated tape desired to be left uncut, the step portions being separated by a distance less than the length of the cutting edge; and a support mechanism for supporting the cutting blade movable toward and away from the support base, movement of the cutting blade toward the support base bringing the cutting edge into abutment with both of the step portions.

13. A tape printer as claimed in claim 12, wherein the support mechanism includes:

a blade support member for supporting the cutting blade; and a pivotal shaft pivotably supporting the blade support member and separated from the cutting blade in a direction following the cutting edge along the length of cutting edge, whereby pivoting movement of the blade support member about the pivotal shaft moves the cutting blade into contact with the laminated tape progressively from portions of the cutting edge closer to the pivotal shaft to portions of the cutting edge farther from the pivotal shaft.

14. A tape printer as claimed in claim 12, wherein the step portions are configured so that portions thereof that abut with the cutting edge are connected by an imaginary line in parallel with the base surface.

15. A tape printer as claimed in claim 12, wherein the support mechanism is provided with a leg portion that abuts against one of the step portions when the both edges of the cutting edge abut against the step portions.

16. A tape printer as claimed in claim 12, wherein the step portions are separated by a distance greater than a width of the laminated tape to be cut.

17. A tape printer as claimed in claim 12, wherein the support mechanism includes a blade support member for supporting the cutting blade, the cutting blade being attached to the cutting blade so that the cutting edge of the cutting blade protrudes from the blade support member by a distance equal to or greater than a thickness of the laminated tape to be cut.

18. A tape printer as claimed in claim 12, wherein the cutting blade is attached to the blade support member with an orientation that aligns the cutting edge in parallel with the base surface when the cutting edge abuts the step portions.

19. A method of producing a partial tape cutting unit for cutting one of a release tape and a print tape of a laminated tape configured by the release tape laminated on the print tape, the method comprising the steps of:

pivotably connecting a blade support member to a tape support base, the tape support base being formed with a pair of step portions and a base surface between the step portions, the base surface supporting the laminated tape when the one of the release tape and the print tape is cut, each of the step portions having a height equal to or less than a thickness of the one of the release tape and the print tape;

pivoting the blade support member into abutment against the blade support base; and fixing a cutting blade, for cutting the one of the release tape and the print tape, onto the blade support member so that a cutting edge of the cutting blade abuts against both of the step portions.

20. A method as claimed in claim 19, wherein step of fixing the cutting blade orients the cutting blade so that the cutting edge is parallel with the base surface of the tape support base.

* * * * *